US007181780B1

(12) United States Patent
Chiang

(10) Patent No.: US 7,181,780 B1
(45) Date of Patent: Feb. 27, 2007

(54) SWIMMING GOGGLES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 1 day.

(21) Appl. No.: 11/186,751

(22) Filed: Jul. 22, 2005

(51) Int. Cl.
*A61F 9/02* (2006.01)

(52) U.S. Cl. ..... 2/452; 2/426; 2/439; 2/440

(58) Field of Classification Search ..... 2/452, 2/426, 438, 442, 439, 450, 445
See application file for complete search history.

(56) References Cited

U.S. PATENT DOCUMENTS 4,930,163 A * 6/1990 King ..... 2/444
6,131,246 A * 10/2000 Paulson et al. ..... 24/265 BC
6,276,794 B1 * 8/2001 Chiang ..... 351/43
6,349,420 B1 * 2/2002 Chiang ..... 2/428
6,383,417 B1 * 5/2002 Paulson et al. ..... 264/1.1
6,405,384 B1 * 6/2002 Chiang ..... 2/428
6,446,272 B1 * 9/2002 Lee ..... 2/428
6,691,377 B2 * 2/2004 Pan ..... 24/170
6,691,378 B1 * 2/2004 Chou ..... 24/170
6,694,532 B2 * 2/2004 Chen ..... 2/428
6,832,394 B1 * 12/2004 Chiang ..... 2/428
6,865,753 B2 * 3/2005 Nishida ..... 2/426
2002/0194669 A1 * 12/2002 Takeshi et al. ..... 2/452
2003/0172445 A1 * 9/2003 Kawashima ..... 2/452

* cited by examiner

*Primary Examiner*—Katherine Moran
*Assistant Examiner*—Richale L. Haney
(74) *Attorney, Agent, or Firm*—Troxell Law Office, PLLC

(57) ABSTRACT

A pair of swimming goggles comprises a pair of frames, lenses, a connecting portion, a fastening portion having a side cover and a strap apparatus having an adjusting portion and a strap, wherein an operation zone is formed on the side cover. The adjusting portion can pivotally swing to the operation zone and has a partition. The partition separates the operation zone and the adjusting portion to a first wrapping hole and a second wrapping hole, wherein a blocking face formed at a side of the partition and adjoining the second wrapping hole. The strap comprises a plurality of stop-ribs thereon having a vertical face corresponding to the blocking face and a slant face opposite to the vertical face. By aforementioned devices, the adjusting portion is pivotally swung to and is positioned against the operation zone; thus the strap only can be drawn to be tight; when swing the adjusting portion to incline to the operation zone, thereby the vertical face of the stop-ribs is disengaged from the blocking face, so the user can put off the swimming goggles.

14 Claims, 7 Drawing Sheets

SWIMMING GOGGLES

BACKGROUND OF THE INVENTION

1. Field of the Invention

The present invention relates to a pair of swimming goggles which provides an apparatus for adjusting a strap of the swimming goggles.

2. Prior Art

In general, a pair of swimming goggles comprises: left frame, right frame and a strap member, wherein the strap member including a strap and an adjusting part for adjusting a length of the strap. As is well known, conventional swimming goggles is very difficult to adjust the strap as it is worn on head, thus a wearer has to put off the swimming goggles and then regulate the adjusting part of the strap to a proper length. However, the wearer cannot accurately regulate the strap at one time because the swimming goggles is not worn on head, the wearer can only counts on a feeling to find a proper length. As a result, it makes difficulties for a wearer to adjust the strap. Moreover, the wearer has to put on and off the swimming goggles again and again if he does not regulate the strap to a comfortable and proper position.

SUMMARY OF THE INVENTION

Accordingly, an object of the present invention is to provide a pair of swimming goggles which includes an apparatus for adjusting a strap of the present invention that can be loosen or tighten to an appropriate length quickly, accurately and conveniently.

To achieve the above object, a pair of swimming goggles in accordance with the present invention comprises a pair of frames, lenses, a connecting portion, a fastening portion having a side cover and a strap apparatus having an adjusting portion and a strap, wherein an operation zone is formed on the side cover. The adjusting portion can pivotally swing to the operation zone and has a partition. The partition separates the operation zone and the adjusting portion to a first wrapping hole and a second wrapping hole, wherein a blocking face formed at a side of the partition and adjoining the second wrapping hole. The strap comprises a plurality of stop-ribs thereon having a vertical face corresponding to the blocking face and a slant face opposite to the vertical face. By aforementioned devices, the adjusting portion is pivotally swung to and is positioned against the operation zone; thus the strap only can be drawn to be tight; when swing the adjusting portion to incline to the operation zone, thereby the vertical face of the stop-ribs is disengaged from the blocking face, so the user can put off the swimming goggles.

Other objects, advantages and novel features of the present invention will be drawn from the following detailed embodiment of the present invention with the drawings.

DESCRIPTION OF THE PREFERRED EMBODIMENT

The following descriptions are of exemplary embodiments only, and are not intended to limit the scope, applicability or configuration of the invention in any way.

Figure 1:
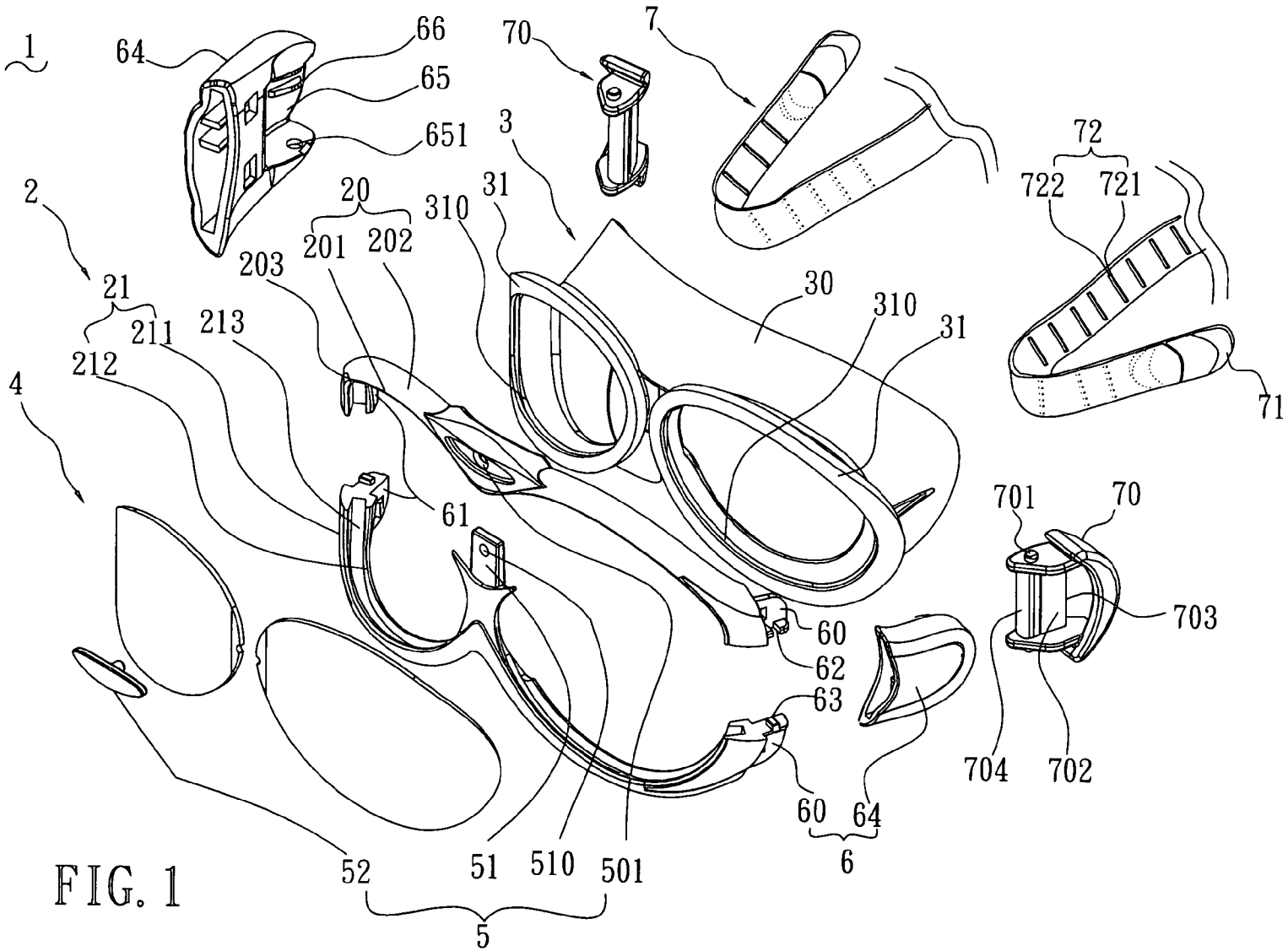
FIG. 1 is an exploded perspective view of a pair of swimming goggles in accordance with a preferred embodiment of the present invention.

Referring to FIG. 1, a pair of swimming goggles 1 in accordance with a preferred embodiment of the present invention comprises a pair of frames 2 including a first frame 20 and a second frame 21, a pad 3, lenses 4, a connecting portion 5, a fastening portion 6 and a strap apparatus 7, wherein the first frame 20 being of W-shape having an outer surface 201 and an inner surface 202, and a first holding groove 203 formed within the outer and the inner surface. The second frame 21 being of W-shape engagable with the first frame 20 having an outer surface 211 and an inner surface 212, and a second holding groove 213 formed within the outer and the inner surface 211, 212 for cooperating with the first holding groove 203 and holding lenses 4.

The pad 3 has a facing part 30 and a receiving part 31, wherein the facing part 30 is formed around the swimming goggles 1 from which an upper flange thereof duly touch a user's eyebrow above and a lower flange duly touch a user's eyehole below. The receiving part 31 is received in the assembled first holding groove 203 and the second holding groove 213 and has a trench 310 surrounding inside thereof.

The connecting portion 5 has a slot 50 and a post 51 disposed at a middle of the first and the second frame 20, 21, and a fixing peg 52 for connecting to the post 51, wherein the slot 50 further includes a connecting hole 501, the post 51 further includes an aperture 510 corresponding to the connecting hole 501, and the fixing peg 52 fixes the post 51 to the slot 50 by inserting through the connecting hole 501 and the aperture 510.

The fastening portion 6 is respectively formed at two ends of the first and the second frame 20, 21 having a first fastening part 60, a second fastening part 61 and a side cover 64 respectively, wherein the first and the second fastening part 60, 61 are respectively formed at two ends of the first and the second frame 20, 21 and respectively have a first engaging unit 62 and a second engaging unit 63 thereon. The first engaging unit 62 is engagable with the second engaging unit 63. The side cover 64 thoroughly covers the first and the second fastening part 60, 61, and defines an operation zone 65 thereon; wherein a first join 651 is disposed in the operation zone 65 and is a pivot hole.

The strap apparatus 7 assembled in the operation zone 65 comprises an adjusting portion 70 and a strap 71, wherein the adjusting portion 70 assembled in the operation zone 65 has a second join 701 for cooperating with the first join 651 and providing the adjusting portion 70 pivotally swinging. Further referring to FIG. 5, a partition 702 is spaced out from the operation zone 65 in order for forming a first wrapping hole A1, and a second wrapping hole A2 is defined at a side of the partition 702 and communicates with the first wrapping hole A1. A blocking face 703 is formed at a side of the partition 702 and adjoins the second wrapping hole A2. The partition 702 further has an arcuate side 704 opposite to the blocking face 703 for facilitating the strap 7 wrapping around. Moreover, the operation zone 65 further comprises a plurality of protrusions 66 corresponding to the first wrapping hole A1. When the adjusting portion 70 pivotally swings to abut the operation zone 65, the protrusions 66 can interfere against the strap 71 (shown in FIG. 5).

The strap 71 comprises a plurality of stop-ribs 72 thereon having a vertical face 721 corresponding to the blocking face 703 and a slant face 722 opposite to the vertical face 721.

Figure 2:
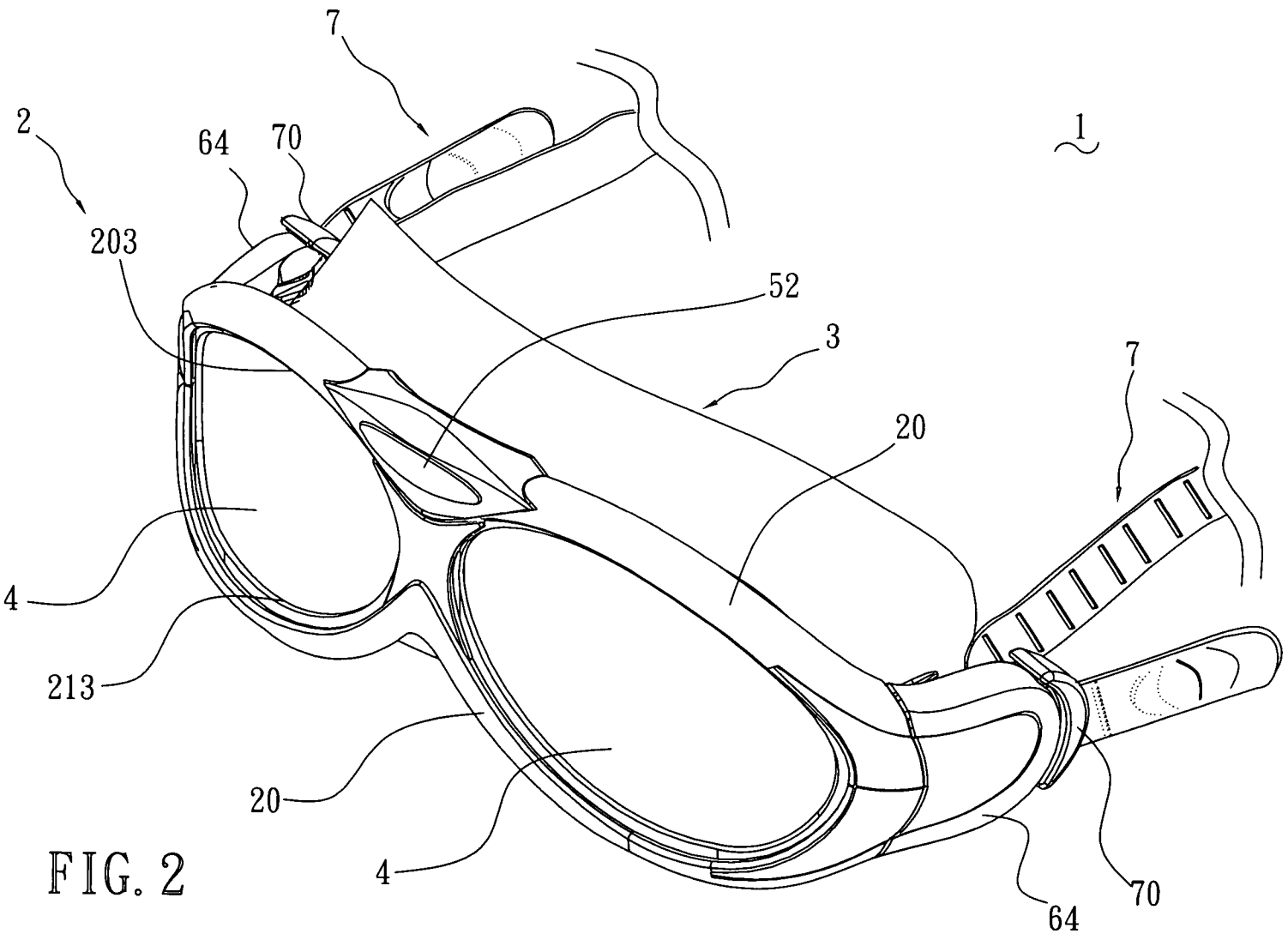
FIG. 2 is an assembled perspective view of FIG. 1.
Figure 3:
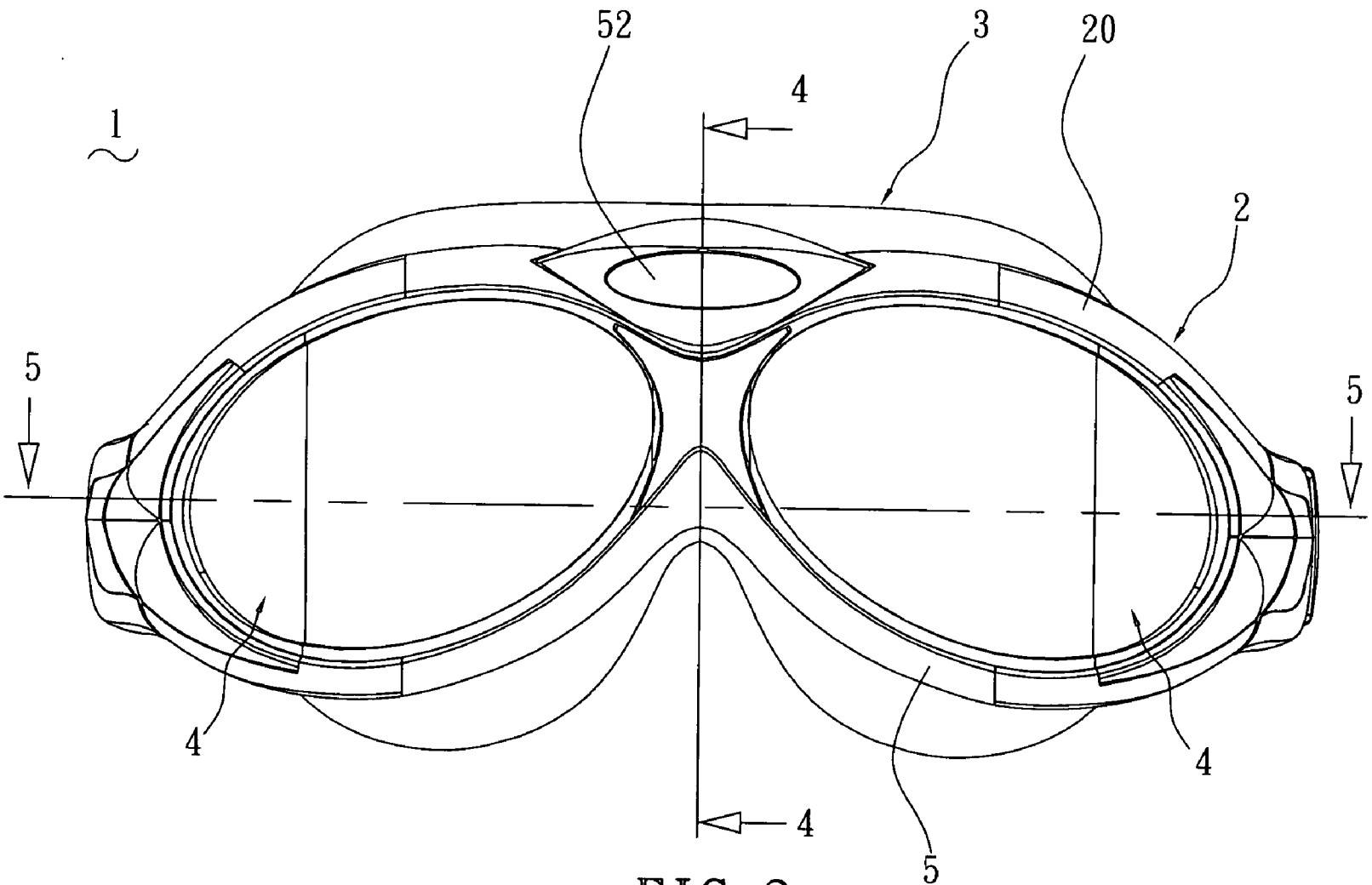
FIG. 3 is a front elevational view of FIG. 2.
Figure 4:
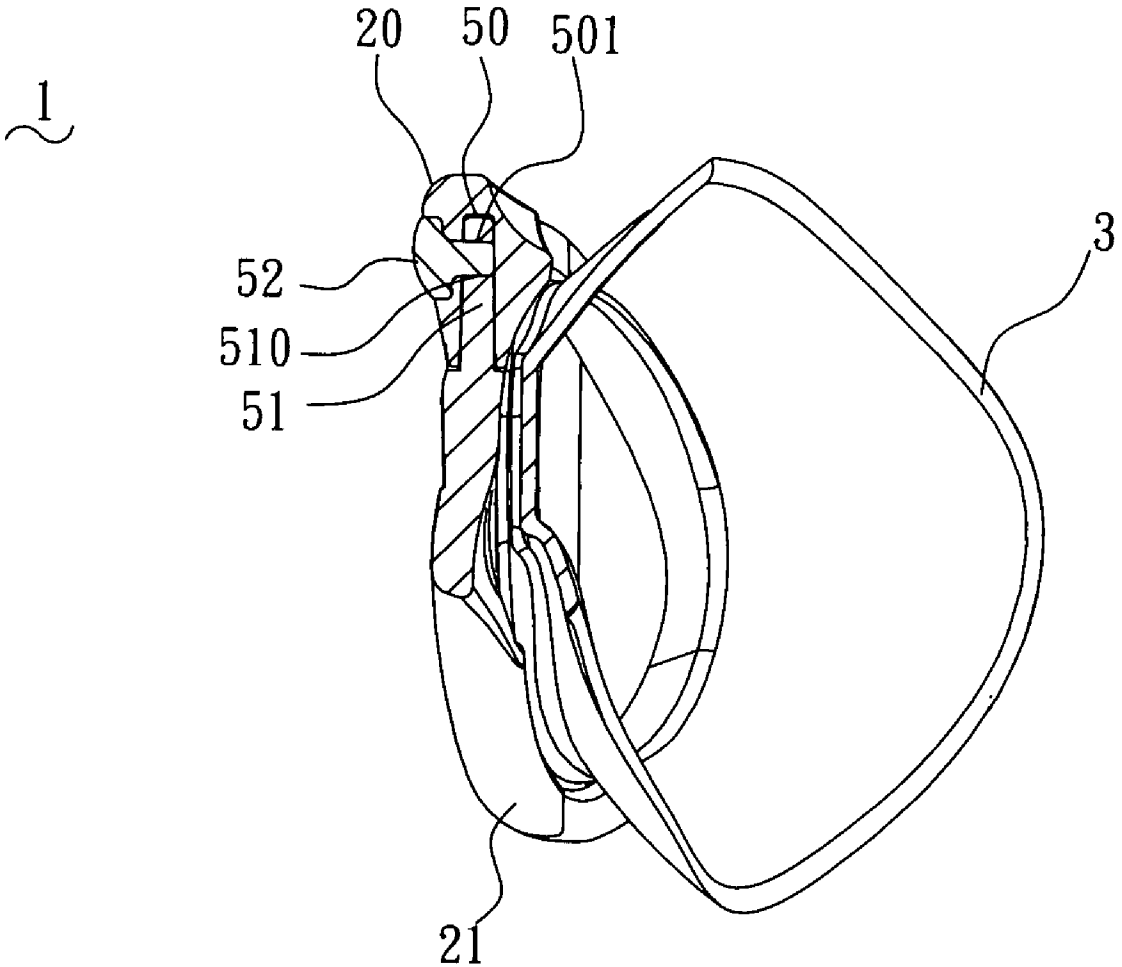
FIG. 4 is a cross-sectional view taken along line 4—4 in FIG. 3.

Referring to FIGS. 1 and 2, to assemble the swimming goggles 1 of the present invention, firstly, fit the lenses 4 onto the trench 310 of the receiving part 31, and assemble the receiving part 31 to the assembled first and the second holding groove 203, 213 as shown in FIG. 2. And by engaging the post 51 of the second frame 21 with the slot 50, then insert the fixing peg 52 into the connecting hole 501 and the aperture 510 to fix the first frame 20 and the second frame 21 (shown in FIG. 4).

Secondly, engage the first engaging unit 62 with the second engaging unit 63 respectively from two ends of the first and the second frame 20, 21, and by way of the side cover 64 to accommodate the first fastening part 60 and the second fastening part 61 to be unitary and therefore to firmly assemble the lenses 4. Furthermore, fit the second join 701 of the adjusting portion 70, for example, a shaft, to the first join 651 of the side cover 64, for example, a pivot hole, thereby, the adjusting portion 70 can pivotally swings at will. Finally, wrap the strap 71 from the first wrapping hole A1 alongside the partition 702 then out from the second wrapping hole A2, thereby the assembly of the swimming goggles 1 is completed as shown in FIG. 2.

Figure 5:
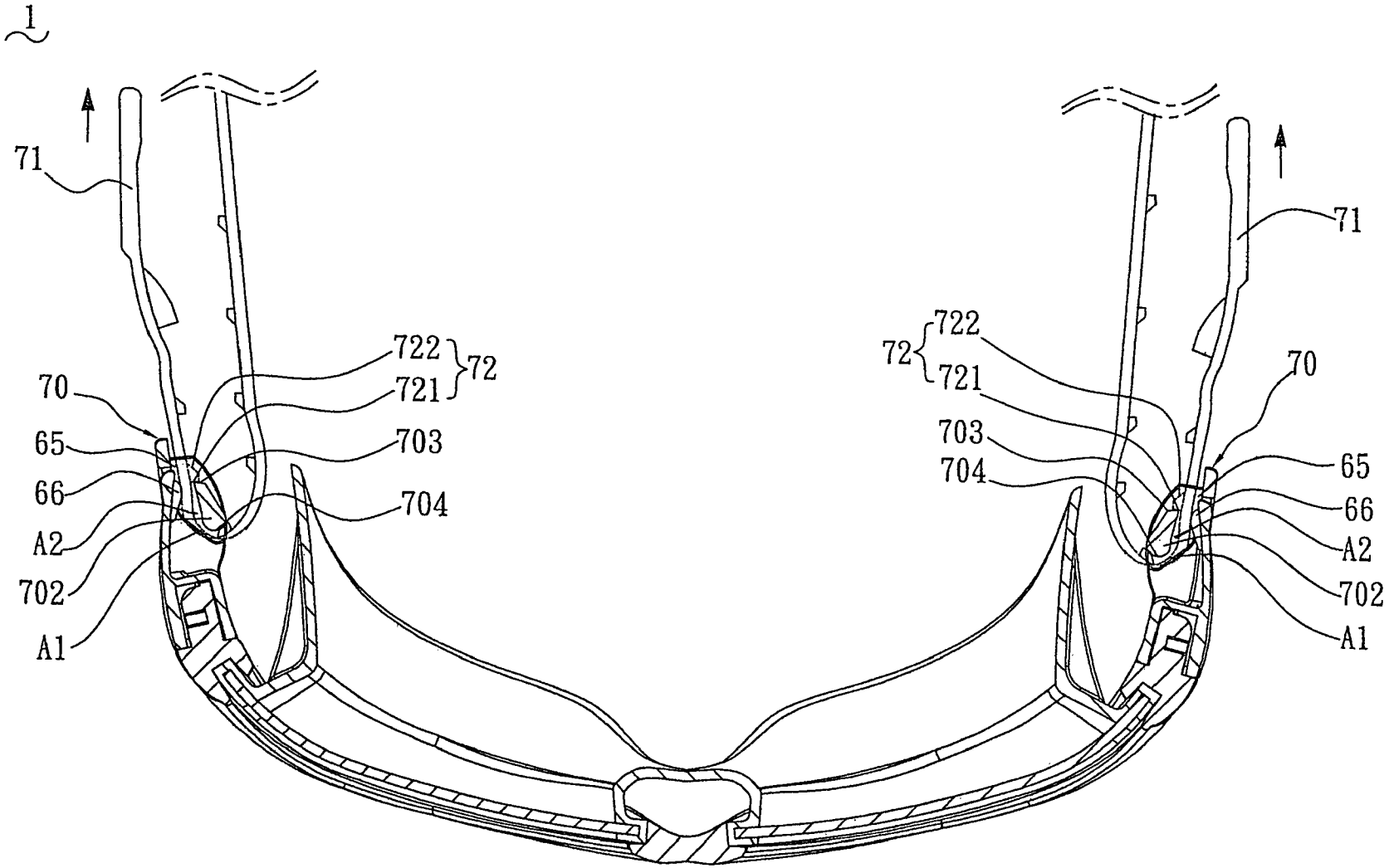
FIG. 5 is a cross-sectional view taken along line 5—5 in FIG. 3.
Figure 6:
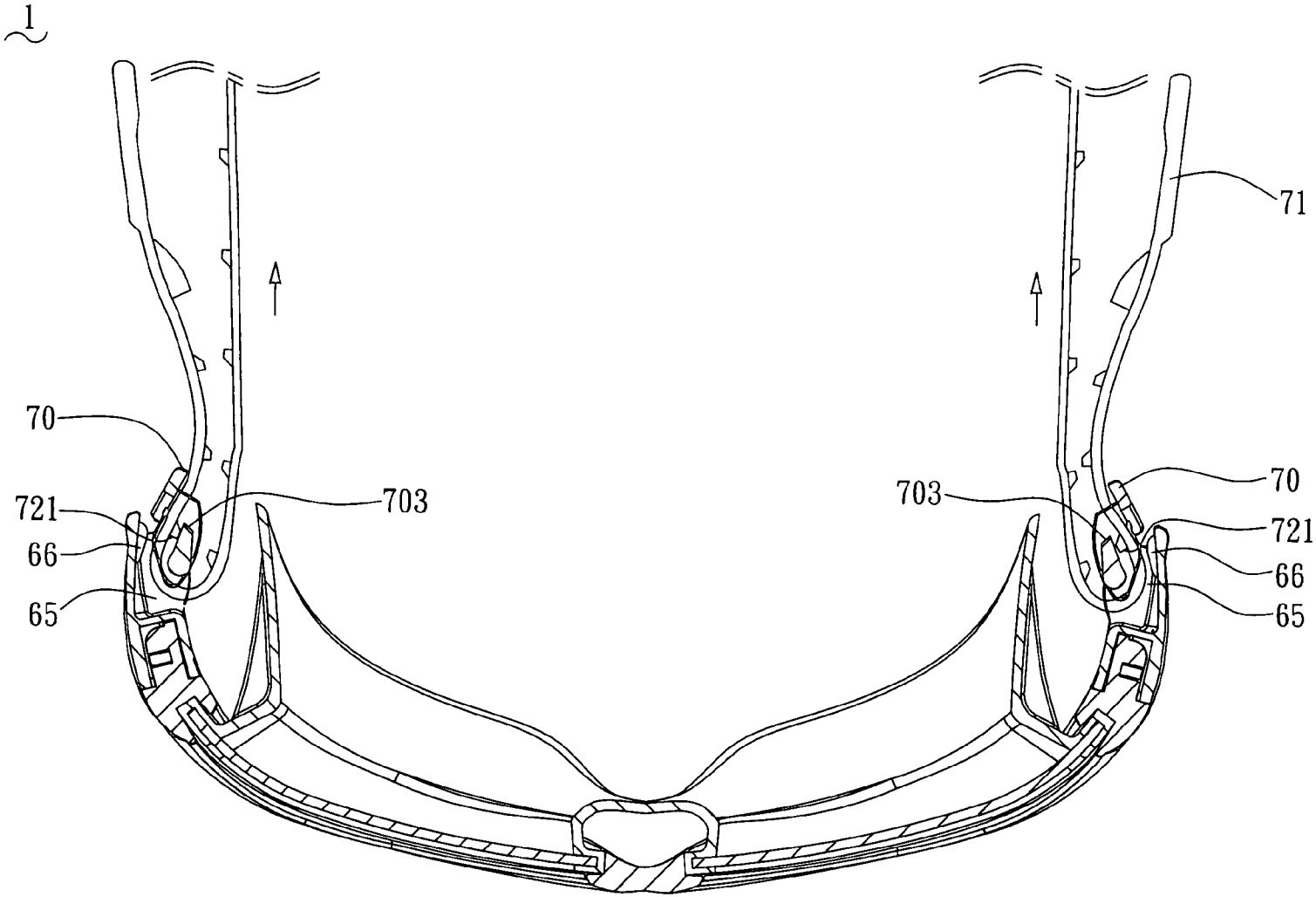
FIGS. 6 and 7 are schematic views illustrating a strap of the swimming goggles being loosened in accordance with the present invention
Figure 7:
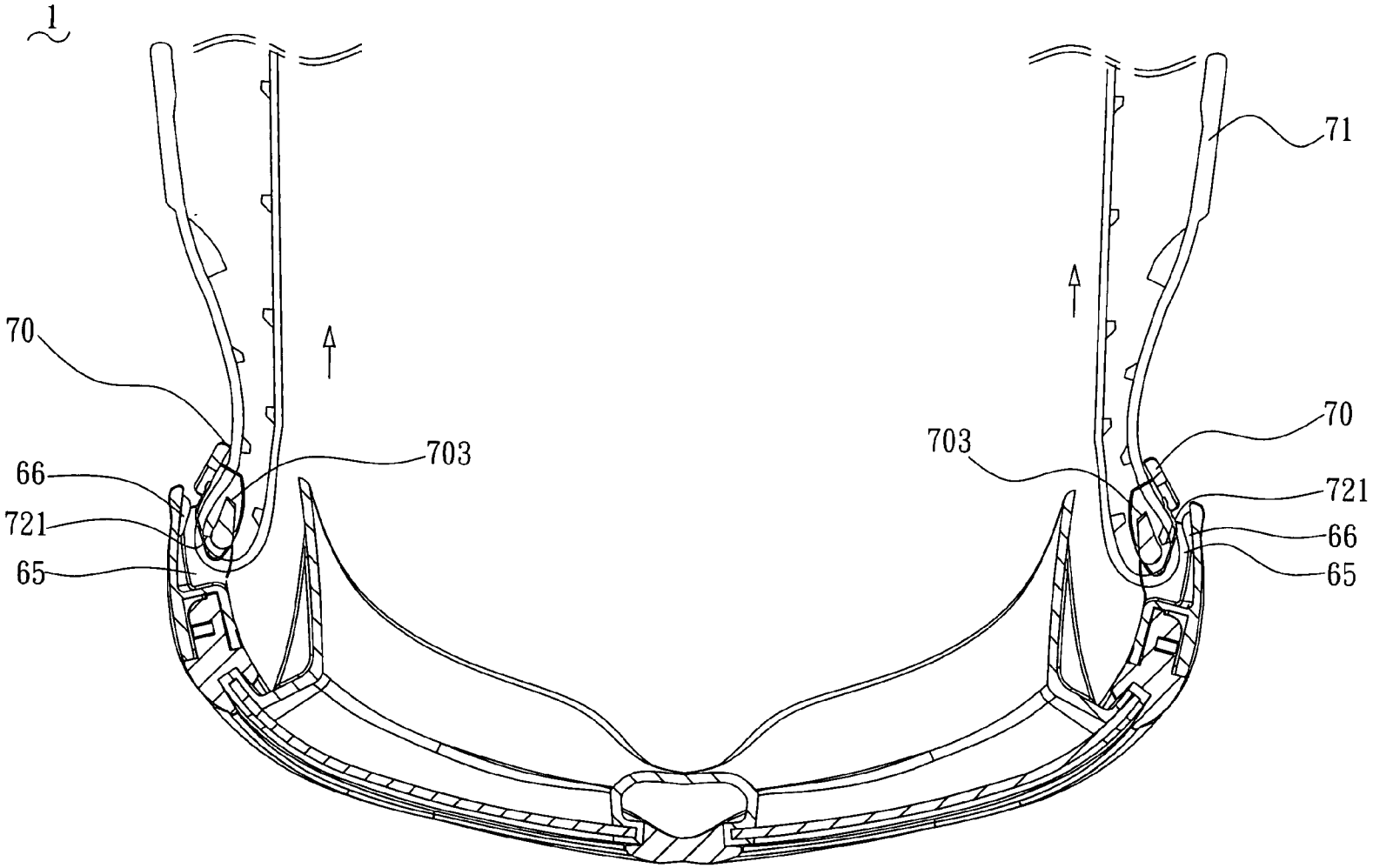

Further to refer to FIGS. 5 to 7, before putting on the swimming goggles 1 of the present invention, draw the strap 71 to a length that is a little wider than the user's head then put it on; draw two ends of the strap 71 backwardly to fit appropriately the head as shown in FIG. 5 where the adjusting portion 70 is pivotally swung to and is positioned against the operation zone 65; thus the strap 71 only can be drawn to be tight (as arrow's direction) thanks to a traction from an inverse direction, the vertical face 721 of the stop-ribs 72 of the strap 71 will stop against the blocking face 703. Referring to FIGS. 6 and 7, when loosen the strap 71, swing the adjusting portion 70 to incline to the operation zone 65 thereby the vertical face 721 of the stop-ribs 72 is disengaged from the blocking face 703; the user can therefore pull the swimming goggles 1 outwardly from eyes, thus the strap 71 will be drawn in arrow's direction and will be loosen accordingly.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A pair of swimming goggles comprising:

a pair of frames connected to each other by a connecting portion, and lenses being received therein, wherein an operation zone formed on the pair of frames having a first join;

a strap apparatus assembled in the operation zone comprising an adjusting portion and a strap, wherein the adjusting portion assembled in the operation zone, and having a second join for cooperating with the first join and providing the adjusting portion pivotally hinging, a partition spaced out from the operation zone and defining a first wrapping hole therein, and a second wrapping hole disposed at a side of the partition communicating with the first wrapping hole, and a blocking face formed at a side of the partition and adjoining the second wrapping hole;

the strap comprising a plurality of stop-ribs thereon having a vertical face corresponding to the blocking face and a slant face opposite to the vertical face, wherein the adjusting portion is configured to in a first position swing inwardly towards the lenses to bind the strap and in a second position swing outwardly to release the strap.

2. The swimming goggles as claimed in claim 1, wherein the first join is a pivot hole, and the second join is a shaft.

3. The swimming goggles as claimed in claim 2, wherein the partition has an arcuate side opposite to the blocking face for facilitating the strap wrapping around.

4. The swimming goggles as claimed in claim 1, wherein the operation zone further comprises a plurality of protrusions corresponding to the first wrapping hole.

5. The swimming goggles as claimed in claim 4, wherein the protrusions are arcuated.

6. The swimming goggles as claimed in claim 1, wherein the blocking face is inclined.

7. A pair of swimming goggles comprising:

a pair of frames including a first frame and a second frame, wherein the first frame being of W-shape having an outer surface and an inner surface, and a first holding groove formed within the outer and the inner surface;

the second frame being of W-shape engagable with the first frame having an outer surface and an inner surface, and a second holding groove formed within the ourter and the inner surface for cooperating with the first holding groove and holding lenses;

a connecting portion having a slot and a post disposed at a middle of the first and the second frame, and a fixing peg for connecting to the post;

a fastening portion having a first fastening part and a second fastening part respectively formed at two ends of the first frame and the second frame and respectively having a first engaging unit and a second engaging unit thereon being engagable with each other, a side cover thoroughly covering the first and the second unit, and an operation zone formed on the side cover having a first join;

a strap apparatus assembled in the operation zone comprising an adjusting portion and a strap, wherein the adjusting portion assembled in the operation zone having a second join for cooperating with the first join and providing the adjusting portion pivotally hinging, a partition spaced out from the operation zone and defining a first wrapping hole therein, and a second wrapping hole disposed at a side of the partition communicating with the first wrapping hole, and a blocking face formed at a side of the partition and adjoining the second wrapping hole;

the strap comprising a plurality of stop-ribs thereon having a vertical face corresponding to the blocking face and a slant face opposite to the vertical face, wherein the adjusting portion is configured to in a first position swing inwardly towards the lenses to bind the strap and in a second position swing outwardly to release the strap.

8. The swimming goggles as claimed in claim 7, wherein the first join is a pivot hole, and the second join is a shaft.

9. The swimming goggles as claimed in claim 8, wherein the partition has an arcuate side opposite to the blocking face for facilitating the strap wrapping around.

10. The swimming goggles as claimed in claim 7, wherein the blocking face is inclined.

11. The swimming goggles as claimed in claim 7, wherein the operation zone further comprises a plurality of protrusions corresponding to the first wrapping hole.

12. The swimming goggles as claimed in claim 11, wherein the protrusions are arcuated.

13. The swimming goggles as claimed in claim 7, further comprises a pad having a facing part and a receiving part, wherein the receiving part is received in the assembled first holding groove and the second holding groove and has a trench surrounding inside thereof.

14. The swimming goggles as claimed in claim 7, wherein the slot of the connecting portion further includes a connecting hole, and the post further includes an aperture corresponding to the connecting hole.

* * * * *